US005259604A

United States Patent [19]

Schneider et al.

[11] Patent Number: 5,259,604

[45] Date of Patent: Nov. 9, 1993

[54] CROSS-FOLDING APPARATUS FOR PRINTED WEBS, PARTICULARLY TO OBTAIN ONE-THIRD/TWO-THIRD FOLDS SUPERIMPOSED

[75] Inventors: Eckhard Schneider, Stadtbergen; Klaus-Ulrich Lange, Gersthofen, both of Fed. Rep. of Germany

[73] Assignee: Man Roland Druckmaschinen AG, Offenbach am Main, Fed. Rep. of Germany

[21] Appl. No.: 888,193

[22] Filed: May 26, 1992

[30] Foreign Application Priority Data

Jun. 22, 1991 [DE] Fed. Rep. of Germany ..... 4120630

[51] Int. Cl.[5] ..... B42C 1/00; B41F 13/58

[52] U.S. Cl. ..... 270/047; 270/6; 270/13; 270/19; 270/21.1

[58] Field of Search ..... 270/1.1, 4, 20.1, 21.1, 270/32, 6, 10, 12, 13, 19, 38, 43, 47; 83/154; 493/344, 349, 363, 365, 428, 429

[56] References Cited

U.S. PATENT DOCUMENTS

| | | | |
|---|---|---|---|
| 269,019 | 12/1882 | Crowell | 270/5 |
| 321,683 | 7/1885 | Campbell | 270/4 X |
| 652,817 | 7/1900 | Spalckhauer | 270/43 |
| 1,970,931 | 8/1934 | Crafts | 270/6 |
| 2,139,241 | 12/1938 | Meyer | 270/32 |
| 2,499,570 | 3/1950 | Crafts | 270/21.1 |
| 3,242,781 | 3/1966 | Risica | 83/154 |
| 5,165,671 | 11/1992 | Motooka | 270/21.1 |

FOREIGN PATENT DOCUMENTS 2920625 11/1980 Fed. Rep. of Germany .

OTHER PUBLICATIONS

"Braun, Atlas des Zeitungs-und Illustratinsdruckes"(-Braun, Atlas of Newspaper and Magazine Printing), published by Polygraph Verlag GmbH, Frankfurt am Main, 1960, p. 95.

*Primary Examiner*—Edward K. Look
*Assistant Examiner*—John Ryznic
*Attorney, Agent, or Firm*—Frishauf, Holtz, Goodman & Woodward

[57] ABSTRACT

To cross-fold a moving web into one-third lengths, a cutter blade cylinder (1, 26) is at a cutting position with a counter cylinder (4, 28), which carries needles and may also carry cutting knives. The cutting knives are arranged to cut the web into a format of one-third/two-third length, respectively. The needles (5, 6) on the cylinder transfer the one-third cut element to a second needling cylinder (9, 32) which re-transfers the cut elements to a group of needles (6) on the first needling cylinder (4, 28) so that the one-third length portion is superimposed on the two-third length portion. These two superimposed portions are then transferred to a combination needling-folding blade cylinder (10, 33) which folds the two-third portion in half and transfers the fold to a folding jaw cylinder (14, 38) so that the one-third portion is interlaced into the two-thirds portion. The arrangement has the advantage that the punctures from the puncturing needles are at the outer margin, which can be small, and be trimmed off.

9 Claims, 2 Drawing Sheets

CROSS-FOLDING APPARATUS FOR PRINTED WEBS, PARTICULARLY TO OBTAIN ONE-THIRD/TWO-THIRD FOLDS SUPERIMPOSED

FIELD OF THE INVENTION

The present invention relates to an apparatus for cross-folding of webs, typically moving webs derived from a printing machine, and more particularly to such an apparatus which can provide folds of one-third/two-thirds of the length of a predetermined format, that is, to fold a cut portion of the web into one-third folds.

BACKGROUND

Products derived from a printing machine are frequently folded into thirds when intended for production of books. A folding apparatus for such products is described in the referenced Lange German Patent 29 20 625, see especially FIG. 5 thereof. The web is cut between a cutter blade cylinder and a combination needling-folding blade cylinder to format length and subsequently transferred into a folding jaw of a folding jaw cylinder, during which transfer the sheet is folded in the relationship of $\frac{2}{3}$ to Ω. Upon subsequent transfer into the folding jaw of a further folding jaw cylinder, a second cross fold to one-third of the length of the format is obtained.

This arrangement has the advantage that the needles are at the outer margins, so that a needling strip can be used in which the needle portion can be cut off with low loss of paper. This is important in the production of books. The operating speed of the folding arrangement, however, is limited by the fact that, upon forming the first cross fold, two-thirds of the sheet must be pulled off by the combination needling-folding blade cylinder counter its direction of rotation.

The referenced literature, "Braun, Atlas des Zeitungsund Illustrationsdruckes" ("Braun, Atlas of Newspaper and Magazine Printing"), published by Polygraph Verlag GmbH, Frankfurt am Main, 1960, p. 95, describes a folding apparatus in which, first, a web is cut to the required length of the format between a cutter blade cylinder and the combination needling and folding blade cylinder. The cut sheet can be folded to two-thirds of its length upon transfer into the folding jaws of a folding jaw cylinder, by suitably locating the operating elements thereof. The folded jaw is then transferred to grippers of a combination gripper-folding blade cylinder which, upon subsequent transfers into the folding jaw of a folding jaw cylinder, the sheet is folded to one-third of the length of the format.

The arrangement as described prevents pull-off of two-thirds of the length of a sheet counter the direction of rotation of a cylinder. On the other hand, the use of grippers also decreases the operating speed and the needling holes in the fold products are at the inside, so that the waste and loss of paper upon cutting and trimming is high.

THE INVENTION

It is an object to improve folding apparatus of the prior art so that it can operate at a higher speed than heretofore, while retaining the advantage that the needling points should be as far as outside of the format as possible. Additionally, grippers on cylinders should preferably be avoided, and long sheets of paper should not be drawn off from cylinders counter their direction of rotation.

Briefly, the moving web, derived from a printing machine, is cut in the relationship of approximately one-third/two-thirds and the two so cut portions of the format are placed above each other and a cross fold is formed which will cause the cut sheet to lie on a one-third portion of the two-third portion from the original format. Only one-third of the sheet of the format must be pulled off counter the direction of rotation of a cylinder, which substantially improves the operating speed of the folding apparatus. The needling points of the respective portions are at the outside or margins, so that they can be trimmed with low paper loss.

Alternatively, the web is first cut to form the format which is then to be divided. The format is severed in the relationship one-third to two-thirds, the portions are placed above each other and cross-folded. Again, the apparatus operates at high speed.

The apparatus, in accordance with a feature of the invention, thus includes a cutter blade cylinder which can be arranged to have a pair of cutter knives spaced, with respect to each other, by one-third of the length of the format to provide the one-third/two-third portion. The cutter blade cylinder cooperates with a needling cylinder. Alternatively, the cutter knives can be located on the needling cylinder and the cutter cylinder merely forms a counter therefor, so that the cutter knives are located on the needling cylinder rather than the needling cylinder forming the counter for the cutter blade cylinder. The needling cylinder has needling systems which are circumferentially spaced from each other by one-third of the length of the format. A second needling cylinder is provided operatively associated with the first needling cylinder, and having second needling system which are circumferentially spaced from each other by one-third of the length of the format, the second needling cylinder being located downstream, in the direction of movement of the web, from the cutter blade cylinder, or cutter counter cylinder, the second needling cylinder having a circumference which is other than an integral multiple of the length of the format. A folding jaw cylinder is operatively associated with a combination needling-folding blade cylinder, and located downstream of that combination needling-folding blade cylinder with respect to the first needling cylinder.

In accordance with a feature of the invention, the spacing of the needles on the first needling cylinder, or the spacing of the cutter blades of the respective cylinder with respect to each other can be changed, so that the margin, to be trimmed off later, can be suitably adjusted.

DRAWINGS

DETAILED DESCRIPTION

Figures 1, 2:
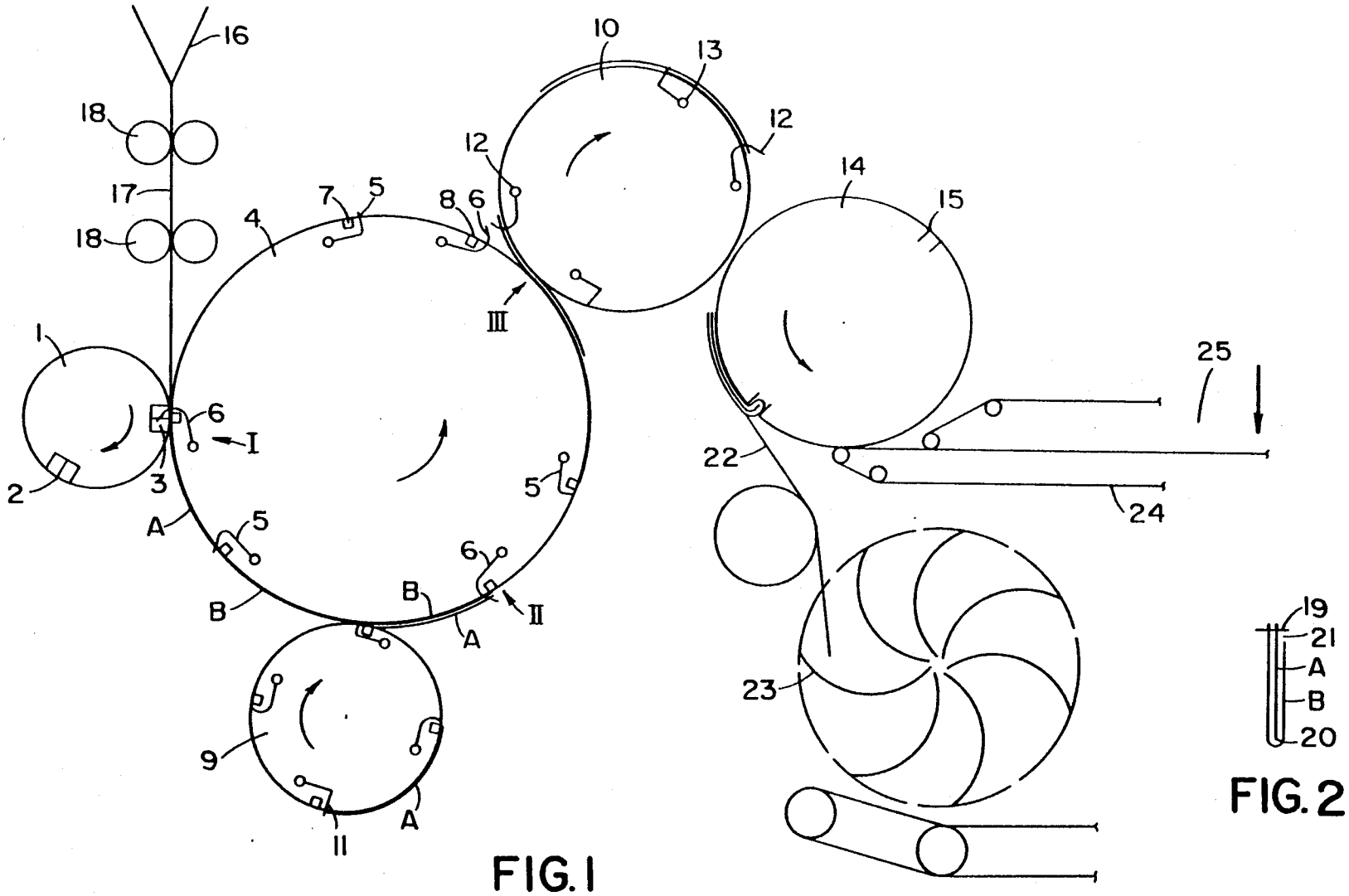
FIG. 1 is a highly schematic side view of a system in accordance with a first embodiment of the invention.
FIG. 2 is a highly schematic side view of the folded product which results, and illustrating a trimming line.

Referring first to FIG. 1:

The cross-folding arrangement has a cutter blade cylinder 1 which has a circumference corresponding to the length of the format into which a web is to be cut to form the cut sheets. The cutter cylinder 1 has two cutter blades 2, 3 located on its circumference. They are circumferentially spaced from each other by one-third of the length of the format. The cutter cylinder 1 is in operative association with a first needling cylinder 4. The needling cylinder 4 has three times the circumference of the cutter cylinder 1 and has three pairs of needle system 5, 6 located thereon. The needling systems 5, 6 are spaced from each other by a circumferential distance of one-third of the length of the format. The needling cylinder 4 additionally has counter cutter grooves 7, 8, positioned for cooperation with the cutter blades 2, 3 of the cutter cylinder 1.

A group of further cylinders is located downstream of the cutter cylinder 1, with respect to the direction of rotation thereof. This group includes a second needling cylinder 9, and a combination needling-folding blade cylinder 10. The second needling cylinder 9 has four needling systems 11, located on the circumference thereof spaced, circumferentially, from each other by one-third of the length of the format. The combination needling-folding blade cylinder 13 has twice the circumference of the cutter cylinder 1, and has two needling systems 12 and two folding blade systems 13 thereon. The spacing of the folding blades or folding blade systems 13 from the needling systems 12, circumferentially, are one-third of the length of the format, in which the needling systems 13 are positioned circumferentially ahead of, or leading the folding blades 13. A folding jaw cylinder 14 is located in operative association with the combination needling-folding blade cylinder 10. The folding jaw cylinder 14 has two folding jaws 15. The circumference of the folding jaw cylinder 15 is twice the circumference of the length of the format.

A web 17 is fed to the folding apparatus from a printing machine. The web 17 is longitudinally folded once by a folding former or folding triangle 16, and fed to the cross-cutting apparatus by pulling rollers 18. The web 17, folded longitudinally, thus is supplied to the nip between the cutter cylinder 1 and the first needling cylinder 4.

OPERATION

The web 17 is cut at the nip of the cutter blade cylinder 1 and the first needling cylinder 4 by the cutter blades 2, 3 in combination with the cutter grooves or counter elements 7, 8, to form two sections A and B (FIG. 2) of, respectively, one-third and a little over two-third length of the desired format. These cut elements or sections are picked up at position I by the needling systems 5, 6 of the needling cylinder 4. As the first needling cylinder 4 rotates, the sections A are picked up by the needling systems 11 of the needling cylinder 9. The needling cylinder 9, upon its next rotation, re-transfers the sections A back to the needling cylinder 4 which, however, are then in a position to be needled by the needling systems 6, which also had the sections B thereon. Thus, the sections A are placed above the sections B, see position II of FIG. 1.

The sections A and B are transferred to the combination needling-folding blade cylinder 10 at the nip between cylinder 10 and needling cylinder 4 at station III. The sections A and B thus are transferred to the needling system 12 on the combination cylinder 10. After rotation of the combination needling and folding blade cylinder 10, the folding blades 14 of the combination cylinder will become operative for the folding operation. The sections A and B are pushed by the folding blades 14 into the folding jaws 15 of the folding jaw cylinder 14, to provide a first cross fold of the two thirds format length portion, with the one-third cut portion therebetween, see FIG. 2. The section A now is retained or folded within the folded section or portion B. The needle holes 19 of the finished product 20, see FIG. 2, are at the outer margin. The overlap 21 can be controlled and adjusted by suitable placement and adjustment of the cutter knives 2, 3, the needling systems 5, 6, and folding blade 13 as well as needling systems 12, all with respect to each other. The folded product 20 can then be transferred by a suitable transfer system 22 to a paddle wheel distributor 23; preferably, an additional transport system 24, formed for example of a dual belt system, is provided so that, as desired, selected folded products can be directed, selectively, either to the paddle wheel distributor 23 or the belt system 24, for subsequent folding, for example at a longitudinal folder 25, illustrated schematically by an arrow.

EMBODIMENT OF FIG. 3

A web 41, pulled over a former 40 by suitable pulling rollers 42 is cut to length by a cutter blade cylinder 26, having a cutter blade system 27, to a suitable format length. The cutter blade cylinder 26 has a circumference equal to the length of the format. The cutter blade cylinder 26 is operatively associated with a needling cylinder 28, which has a circumference three times that of the length of the format. In addition to having needling systems 30, the needling cylinder 28 has three cutter blades 29, so that cylinder 28 can be termed a combination cutter blade-needling cylinder. The three cutter blades 29 on the combination cutter blade-needling cylinder 28 are spaced from the needling system 30 by a circumferential distance of approximately one-third of the length of the format. The needling systems 30 have cutter grooves or cutter counter elements 31 associated therewith.

A second needling cylinder 32 and a combination needling-folding blade cylinder 33 are associated with the combination needling-cutter blade cylinder 28, downstream of the cutter blade cylinder 26, with respect to the direction of rotation of the combination cylinder 28. The needling cylinder 32 has four needling systems 34, circumferentially spaced from each other by a distance of one-third of the format, and the needling systems have cutter grooves or counter elements 35 placed close thereto and associated therewith. The combination needling and folding blade cylinder 33 has twice the circumference of the cutter cylinder 26 and has two needling systems 36 as well as folding blades 37. The spacing between each two needling systems 36 and the folding blades 37, circumferentially, is one-third of the length of the format. A folding jaw cylinder 38 is associated with the combination needling and folding blade cylinder 33. The folding jaw cylinder has a circumference of two lengths of format, and has two folding jaws.

OPERATION, FIG. 3

The longitudinally folded web 41, guided over the folding former 30 and pulled by the rollers 42, is longitudinally folded and supplied to the cross folding system. The web 42 is cut by the cutter cylinder 28 into sheets having the requisite length of the format at the nip between the cutter cylinder 26 and the combination needling-cutter blade cylinder 28. The sheets are retained on the needling systems 30. As the combination needling-cutter blade cylinder 28 rotates in the direction of the arrow shown within the cylinder 28, the cutter blades 29 on the combination needling-cutter blade cylinder 28 will engage in the counter cutter grooves or counter elements of the needling cylinder 32, to form sections A and B having, respectively, lengths of one-third and a little over two-thirds of the format, to account for later trimming of overlap 21. The sections A are received by the needling systems 34 on the second needling cylinder 32; the longer sections B, however, remain on the combination needling and cutter cylinder 28.

The second cutter cylinder 32, upon its next revolution, transfers the portions A back to the combination needling and cutter cylinder 28. These sections A are received by the needling systems 30 of the cylinder 28 and placed on top of the longer, that is, the two-third length sections or portions B.

When these two now superposed sections reach the nip of the needling and cutter blade cylinder 28 and the needling and the needling and folding blade cylinder 33, sections A, B, together, are transferred to the needling system 36 on the cylinder 33. After some rotation of the combination needling and folding blade cylinder 33, the sections A and B are pushed by the folding blades 37 of the combination needling-folding blade cylinder 33 at the nip with the folding jaw cylinder 38 into the folding jaws 39 thereof by the folding blades 37. Thus, a single cross fold is formed and the product shown in FIG. 2 will result. Again, the overlap or extension 21 can be adjusted or controlled by suitable reponsitioning of the cutter knives 29, the needling systems 30, the folding blade 37 and the needling systems 36, with respect to each other.

The folded product 20 is then, as before, guided over a guide system 43, selectively, to a paddle wheel distributor 44 or to a belt system 45, where it can be longitudinally folded by a subsequent longitudinal folding arrangement as well known in the prior art, and only schematically indicated at 46.

The relative relationship of size of the cylinders are merely exemplary. Other relative diametrical relationships can be selected. For example, the cutter blade cylinder 1, 26 may be twice the length of the format, the needling cylinder 4 or the combination needling-cutter cylinder 28 may be five times the format length, the combination needling and folding blade cylinder may have three times the format length, and the second needling cylinder 9 or 32, respectively, five-thirds of the format length.

The respective cylinders could have additional operating elements associated therewith. For example, the needling cylinder 4 could have folding blades applied thereto; the needling and folding blade cylinder 10 could be equipped with folding jaws. The folding jaw cylinder 14 additionally can be equipped with grippers, so that it is possible by the system to additionally fold the sheet cut to format to one-half or one-quarter length of the format.

Various other changes and modifications may be made and any features described herein may be used with any of the others, within the scope of the inventive concept.

What is claimed is:

1. Apparatus for cross-folding printed, moving webs supplied by a rotary printing machine in a predetermined format having a predetermined length to one-third of the length of the format, comprising a pair of cutter blade-counter element cylinders (1, 4; 26, 28), operatively associated and positioned for cutting the webs;

cutter knives (2, 3; 27, 29) located on said cylinders and spaced to cut the moving web into, respectively, approximately one-third and two-third length of the format, one (4; 28) of said paired cylinders additionally carrying puncturing needles (5, 6; 30);

a combination needling-folding blade cylinder (10, 33) operatively coupled to that one (4; 28) of said cylinder pair which carries the puncturing needles (5, 6; 30), said puncturing needles (5, 6; 30) on said one (4; 28) of said paired cylinders being circumferentially spaced from each other by one-third of the length of the format, or a multiple thereof;

a second needling cylinder (9, 32) operatively coupled with that one (4; 28) of the pairs of cylinders which carries the puncturing needles (5, 6; 30), said second needling cylinder (9, 32) having second needling systems (11, 34) which are circumferentially spaced from each other by one-third of the length of the format, said second needling cylinder (9, 32) being located downstream, in the direction of movement of the web from an engagement nip (I) of said pairs of cylinders (1, 4; 26, 28), said second needling cylinder (9, 32) having a circumference which is other than an integral multiple of the length of the format; and a folding jaw cylinder (14, 38) positioned in operative association with the combination needling-folding blade cylinder (10, 33), and located downstream of the combination needling and folding blade cylinder with respect to that one cylinder (4; 28) of the pairs of cylinders which carries the puncturing needles (5, 6, 30).

2. The apparatus of claim 1, wherein (FIG. 1) one (1) of said pairs of cylinders (1, 4) carries at least one pair of cutter knives (2, 3) spaced circumferentially with respect to each other by one-third of the length of the format.

Figure 3:
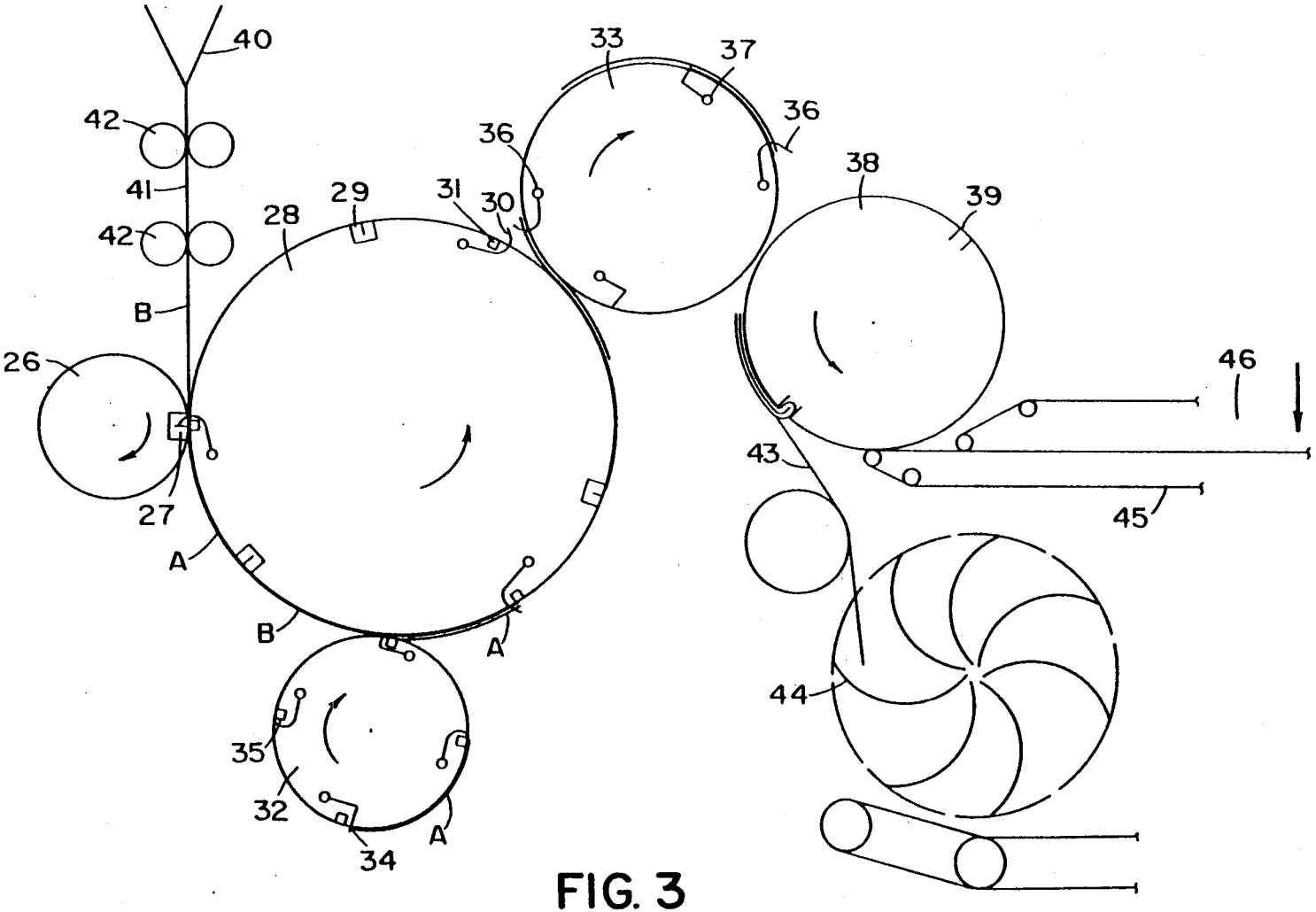
FIG. 3 is a side view similar to FIG. 1, illustrating another embodiment of the invention, in which the relationship of cutter blades to counter elements for the cutter blades between associated cylinders is reversed with respect to the embodiment of FIG. 1.

3. The apparatus of claim 1, wherein (FIG. 3) both cylinders (26, 28) of said pairs of cylinders carry cutter knives (27, 29); and wherein the cutter knives (29) on that one of the cylinders (28) which carries the puncturing needles (30) is arranged such that the spacing between the cutter knives (29) and the puncturing needles thereon corresponds, circumferentially; to one-third of the length of the format.

4. Apparatus for cross-folding printed, moving webs supplied by a rotary printing machine in a predetermined format having a predetermined length to one-third of the length of the format (FIG. 1), comprising a cutter blade cylinder (1) having at least a pair of cutter knives (2, 3) circumferentially spaced with respect to each other by one-third of the length of the format, to cut the web into cut elements having, respectively, approximately two-thirds and one-third length of the format;

a combination needling-folding blade cylinder (10);

a first needling cylinder (4) operatively associated with the combination needling-folding blade cylinder (10) and to the cutter blade cylinder (1), said first needling cylinder (4) having pairs of needle systems (5, 6), which needle systems are circumferentially spaced from each other by one-third of the length of the format;

a second needling cylinder (9) operatively associated with the first needling cylinder (4), said second needling cylinder (9) having second needling systems (11) which are circumferentially spaced from each other by one-third of the length of the format;

said second needling cylinder (9) being located downstream, in the direction of movement of the web, from the cutter blade cylinder (1), and having a circumference which is other than an integral multiple of the length of the format; and a folding jaw cylinder (14) positioned in operative association with the combination needling-folding blade cylinder (10, 33) and located downstream thereof with respect to the first needling cylinder (4).

5. The apparatus of claim 4, wherein the respective spacing of the cutter knives (2, 3) of the pairs of cutter knives of the cutter blade cylinder is adjustable.

6. The apparatus of claim 4, wherein the spacing between individual needle systems (5, 6) forming respective pairs of needle systems of the first needling cylinder (4) is adjustable.

7. Apparatus for cross-folding printed, moving webs supplied by a rotary printing machine in a predetermined format having a predetermined length to one-third of the length of the format (FIG. 3), comprising a cutter blade cylinder (26);

a combination needling and folding blade cylinder (33);

a combination first needling and cutter blade cylinder (28), operatively associated with the cutter blade cylinder (26) and to the combination needling-folding blade cylinder (33), said combination first needling and cutter blade cylinder (28) having a plurality of cutter blades (29) and further having a plurality of needling systems (30), said needling systems being spaced circumferentially from a cutter blade by a distance of approximately one-third of the length of the format, a second needling cylinder (32) operatively associated with the combination first needling and cutter blade cylinder (28), said second needling cylinder (32) having second needling systems (34) which are circumferentially spaced with respect to each other by one-third of the length of the format, said second needling cylinder (32) being located downstream, in the direction of movement of the web, from the cutter blade cylinder (26), and having a circumference which is other than an integral multiple of the length of the format; and a folding jaw cylinder (38) positioned in operative association with the combination needling-folding blade cylinder (33).

8. The apparatus of claim 7, wherein the spacing between the needling systems (30) and the next adjacent cutter blade (29) of the combination needling-cutter blade cylinder (28) is adjustable, said spacing being with respect to the direction of rotation of the combination needling-cutter blade cylinder (28).

9. The apparatus of claim 8, wherein the second needling cylinder (32) carries cutter-counter elements (35) for cutting cooperation with the cutter blades (29) of the combination first needling and cutter blade cylinder (28).

* * * * *